United States Patent [19]

Turner

[11] Patent Number: 4,856,714

[45] Date of Patent: Aug. 15, 1989

[54] FUEL INJECTION NOZZLES

[75] Inventor: Ronald F. Turner, London, England

[73] Assignee: Lucas Industries Public Limited Company, Birmingham, England

[21] Appl. No.: 183,610

[22] Filed: Apr. 19, 1988

[30] Foreign Application Priority Data

Apr. 24, 1987 [GB] United Kingdom ..... 8709715
Oct. 1, 1987 [GB] United Kingdom ..... 8723028

[51] Int. Cl.[4] ..... F02M 61/20
[52] U.S. Cl. ..... 239/533.9; 239/533.11
[58] Field of Search ..... 239/86, 95, 533.2–533.12

[56] References Cited

U.S. PATENT DOCUMENTS

| | | | |
|---|---|---|---|
| 3,224,684 | 12/1965 | Roosa | 239/533.11 |
| 4,202,500 | 5/1980 | Keiczek | 239/533.3 |
| 4,359,191 | 11/1982 | Uchida | 239/533.9 |
| 4,390,129 | 6/1983 | Uchida | 239/533.5 |
| 4,448,356 | 5/1984 | Nakajima et al. | 239/533.5 |
| 4,461,427 | 7/1984 | Kopsé | 239/533.9 X |
| 4,768,719 | 9/1988 | Straubel et al. | 239/533.4 |

FOREIGN PATENT DOCUMENTS

| | | | |
|---|---|---|---|
| 1446628 | 9/1965 | France | 239/533.11 |

*Primary Examiner*—Andres Kashnikow
*Assistant Examiner*—Patrick N. Burkhart
*Attorney, Agent, or Firm*—Balogh, Osann, Kramer, Dvorak, Genova & Traub

[57] ABSTRACT

A fuel injection nozzle of the inwardly opening type has a valve member slidable in a bore in a nozzle body which is secured to a holder. The valve member is biased by a first spring into contact with a seating and is movable from the seating by fuel under pressure. An abutment rod is engageable by the valve member after a predetermined movement of the valve member away from the seating. The abutment rod is biased by a second spring housing in an insert mounted in screw thread engagement with a bore in the holder. The rod extends through and is guided by an aperture in the insert and is further guided by guide means removed from the insert. The guide means can be a bush carried by the holder, the coils of the first spring or the valve member.

4 Claims, 1 Drawing Sheet

FUEL INJECTION NOZZLES

This invention relates to fuel injection nozzles of the so-called inwardly opening type and of the kind comprising a valve member movable in a bore in a nozzle body, the valve member being shaped for co-operation with a seating and being biased into contact with the seating by first resilient means to prevent fuel flow from an inlet to an outlet, the first resilient means being housed in a holder to which the nozzle body is secured, the valve member being lifted from the seating by fuel under pressure supplied to the inlet, second resilient means housed in an insert adjustably mounted in the holder, an abutment rod which is loosely interposed between a part movable with the valve member and the second resilient means to define a gap, the initial movement of the valve member being against the action of the first resilient means until said gap is closed, the further movement of the valve member being against the combined action of the first and second resilient means.

A fuel injection nozzle of the aforementioned type is known from British Patent Specification No. 2071760B . The second resilient means engages a spring abutment plate which is integrally formed with the abutment rod and the latter extends in the direction towards the valve member for engagement in the use of the nozzle, by a part movable with the valve member.

The aforesaid specification describes in some detail the setting of the initial gap between the end of the abutment rod and said part and the force exerted by the first and second resilient means. The two important settings are the force exerted by the first resilient means since this determines the nozzle opening pressure, and the aforesaid gap. The adjustment of the force exerted by the first resilient means is easily effected using a shim but the adjustment of the gap has proved to be less easy. The gap is very small for example, 0.05 mm with a total lift of the valve member of 0.23 mm, and it has been found difficult to obtain consistent settings.

The object of the invention is to provide a fuel injection nozzle of the kind specified in a form in which the constructional adjustment of the nozzle is cheaper and simpler According to the invention in a fuel injection nozzle of the kind specified, the wall of an aperture formed in the base wall of the insert and through which said abutment rod extends forms a guide surface to guide the movement of the rod, the nozzle defining bearing means for said rod located at a position removed from the insert.

Figure 1:
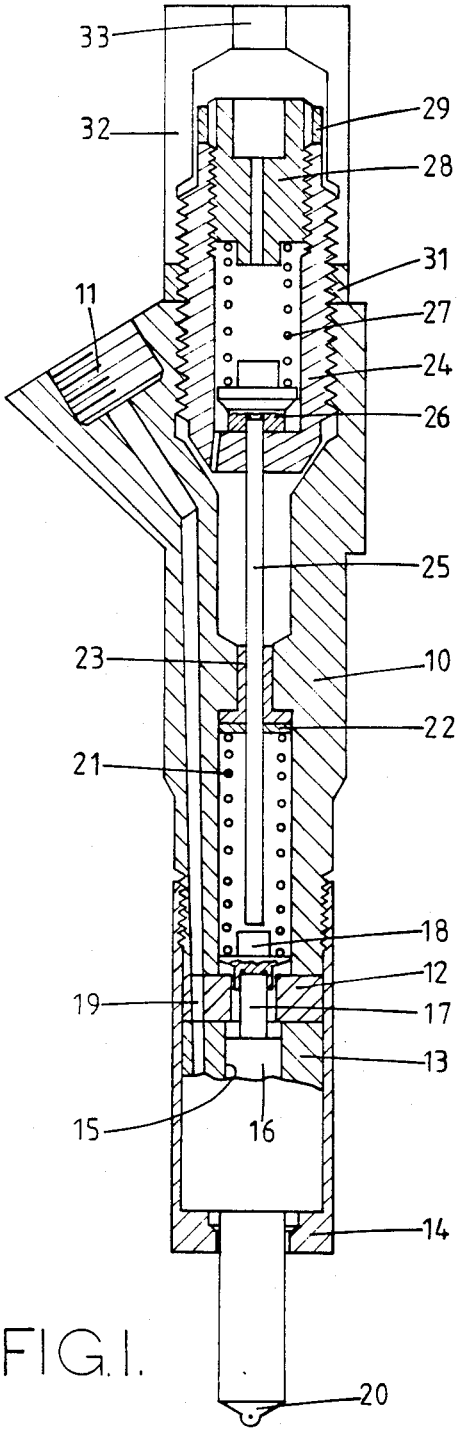
Figure 2:
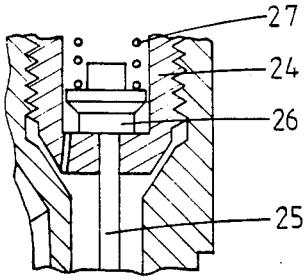
Figure 3:
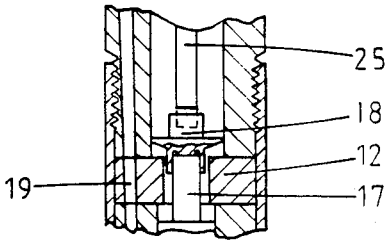
Figure 4:
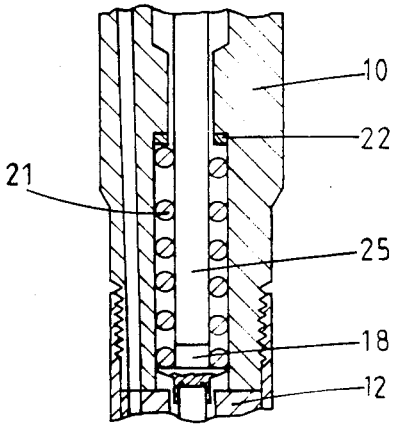

In the accompanying drawings:

FIG. 1 is a sectional side elevation of one example of a fuel injection nozzle in accordance with the invention, and FIGS. 2, 3 and 4 show modifications to parts of the nozzle seen in FIG. 1.

Referring to FIG. 1 of the drawings, the nozzle comprises a holder 10 which is of generally cylindrical form and which adjacent one end has an extension in which is formed a fuel inlet 11 At the other end of the holder there is located a distance piece 12 and a nozzle body 13, the nozzle body and distance piece being held in assembled relationship with the holder 10 by means of a cap nut 14 The nozzle body in known manner, is provided with a bore 15 in which is located a valve member 16 having an integral part or extension 17 which projects through an opening in the distance piece and upon which is mounted a spring abutment 18. The aperture in the distance piece is smaller in diameter than the valve member so that the extent of movement of the valve member away from the closed position in which it is shown, is limited by its abutment with the distance piece.

The valve member is shaped in known manner, to co-operate with a seating defined at the end of the bore 15 and an annular surface is formed on the valve member and against which fuel under pressure supplied by way of a passage 19 from the inlet 11, can act to lift the valve member away from the seating thereby to permit fuel flow from the inlet 11 to an outlet in the form of an orifice 20.

The holder is formed with a bore and the valve member is biased towards the closed position by first resilient means in the form of a coiled compression spring 21 one end of which is mounted on the abutment 18 and the other end of which engages a shim 22. The shim engages the flange of a guide bush 23 located against a step in the bore, and the force exerted by the spring 21 on the valve member and hence the so-called nozzle opening pressure, can be determined by altering the thickness of the shim.

Also provided is an insert 24 which is of generally cup-shaped form having an opening 24A formed in its base wall and through which extends an abutment rod 25. The wall of the opening forms a guide surface for the rod and a further bearing means for the rod is defined by the bush 23. The rod extends through the coiled compression spring 21 to adjacent the abutment 18. Within the insert, there is loosely mounted on the rod a head 26 which forms an abutment for one end of a second coiled compression spring 27. The other end of the spring 27 is engaged by a plug 28 which is in adjustable screw thread engagement with the skirt portion of the insert A locking nut 29 is provided to retain the setting of the plug and insert once adjustment has been effected The insert 24 is in screw thread engagement within the open end of the bore in the holder 10, a lock nut 31 being provided to lock the insert once adjustment has been effected A cap 32 is secured around the insert and defines an outlet 33 for fuel which accumulates within the interior of the nozzle by virtue of fuel leakage along the working clearance defined between the bore and the valve member 16.

In operation, when fuel under pressure is supplied to the inlet 11, the fuel pressure will exert a force on the valve member 16 to lift the valve member from the seating against the action of the spring 21. The extent of movement of the valve member will be limited by the engagement of the abutment 18 and the rod 25. This limited lift of the valve member from its seating allows a restricted flow of fuel through the outlet orifice 20. As the fuel pressure continues to increase, the force exerted on the valve member will eventually become sufficient to move the valve member against the combined action of the springs 21 and 27 and the fully open position of the valve member is determined by the abutment of the valve member with the distance piece 12 as previously described This two stage lifting of the valve member is particularly beneficial when the injection nozzle is used with certain types of engine.

Various adjustments have to be effected during the assembly of the nozzle. The adjustment of the force exerted by the spring 27 can be effected before the insert 24 is assembled to the injector and the setting of the gap between the abutment 18 and the rod 25 is effected by screwing the insert into or out of the holder 10. This gap can be set either before or after adjustment of the force exerted by the spring 21, the latter can be omitted from the assembly in which case the gap is effectively adjusted by supplying fuel at low pressure to the inlet 11 and determining the flow rate through the outlet 20. If the spring 21 has already been assembled into the injector then the fuel supplied through the inlet 11 has to be at least the nozzle opening pressure before the gap can be set. Setting the gap by flow measurement is considered to be more accurate than setting the gap using distance measuring techniques.

In the modification shown in FIG. 2 the head 26 is not mounted on the rod 25. The rod however is still guided by the wall of the opening in the base wall of the insert. The head 26 is guided by the wall of the insert and this modification allows the head 26 to seat against the base wall of the insert irrespective of any slight misalignment of the rod.

In the modification seen in FIG. 3 the guide bush 23 of the example of FIG. 1 is removed and the rod and head 26 are separate items as shown in FIG. 2. The guiding of the end of the rod removed from the insert 24 is achieved either by making the rod integral with the spring abutment 18 or as shown, by locating the rod within a recess in the spring abutment. In both cases the valve member 16 forms the second guide for the rod at a position removed from the insert.

In the modification shown in FIG. 4 the lower end portion of the rod 25 is guided by the coils of the compression spring 21. The guide bush is not required and it is convenient to form the rod to a larger diameter so that it engages with the coils of the spring. The head 26 can be mounted on the rod as shown in FIG. 1 or it can be arranged as shown in FIG. 2.

What is claimed is:

1. A fuel injection nozzle of the inwardly opening type comprising an elongated valve member movable in a bore and a nozzle body, said valve member being shaped at one end for cooperation with a seating, a first spring abutment mounted on said valve member at the other end thereof, a first coiled compression spring having one end engaging said first spring abutment to bias said valve member into engagement with said seating to prevent flow of fuel from an inlet to and outlet, said first coiled compression spring being housed within a holder to which said nozzle body is secured, said valve member being lifted from said seating by fuel under pressure supplied to an inlet, a second coiled compression spring housed within an insert which is adjustably mounted in a holder, a second spring abutment located in said insert adjacent a base wall thereof, and engaged by on end of said second spring, an aperture formed in said base wall, an abutment rod loosely located between said spring abutments to define a gap in the closed position of the valve member, the initial movement of said valve member being against the action of said first spring until said gap is closed, and further movement of said valve member being against the action of said first and said second springs, said abutment rod at one end being guided by the surfaces of said opening in the base wall of said insert, and at a distance from said one end by guide means located apart from said insert.

2. A fuel injection nozzle according to claim 1 characterised in that said guide means comprises a flanged guide bush, the flange of which is located against a step defined in the holder.

3. A fuel injection nozzle according to claim 1 characterised in that said guide means is formed by a coiled compression spring which forms the first resilient means, said abutment rod passing through the spring and co-operating with the coils of the spring.

4. A fuel injection nozzle according to claim 1 characterised in that said abutment rod is integral with or secured to a part carried by said valve member, whereby the valve member forms the guide means for said abutment rod.

* * * * *